US008650725B1

(12) United States Patent
Cooper

(10) Patent No.: US 8,650,725 B1
(45) Date of Patent: Feb. 18, 2014

(54) SYSTEM AND METHOD FOR SECURING A FLEXIBLE PANEL

(76) Inventor: Jonathan E. Cooper, Mount Airy, MD (US)

( * ) Notice: Subject to any disclaimer, the term of this patent is extended or adjusted under 35 U.S.C. 154(b) by 242 days.

(21) Appl. No.: 13/032,292

(22) Filed: Feb. 22, 2011

Related U.S. Application Data

(60) Provisional application No. 61/307,877, filed on Feb. 25, 2010, provisional application No. 61/379,470, filed on Sep. 2, 2010, provisional application No. 61/419,239, filed on Dec. 2, 2010.

(51) Int. Cl.
*E04H 15/64* (2006.01)
*A44B 21/00* (2006.01)

(52) U.S. Cl.
USPC ..... 24/459; 24/72.5; 135/120.1; 135/119; 135/120.4

(58) Field of Classification Search
None
See application file for complete search history.

(56) References Cited

U.S. PATENT DOCUMENTS

| | | | | |
|---|---|---|---|---|
| 1,383,665 | A | 7/1921 | Rohan | |
| 2,939,195 | A | 6/1960 | Carlson | |
| 3,780,400 | A | 12/1973 | Hinsperger | |
| 3,936,912 | A | 2/1976 | Flanagan et al. | |
| 4,308,647 | A | 1/1982 | Gillis | |
| 4,688,304 | A | 8/1987 | Marcott | |
| 4,939,820 | A | 7/1990 | Babcock | |
| 5,033,170 | A | 7/1991 | Ewert | |
| 5,074,014 | A | 12/1991 | Freeman | |
| 5,117,537 | A | 6/1992 | Hunter | |
| 5,168,605 | A | 12/1992 | Bartlett | |
| 5,394,579 | A * | 3/1995 | Walters | 5/504.1 |
| 5,692,272 | A | 12/1997 | Woods | |
| 5,752,297 | A | 5/1998 | Ramey | |
| 6,108,837 | A * | 8/2000 | Knebel, III | 5/504.1 |
| 6,148,488 | A | 11/2000 | Gristock | |
| 6,292,987 | B1 | 9/2001 | Combes | |
| 6,473,944 | B1 | 11/2002 | Vazin | |
| 6,718,600 | B1 | 4/2004 | Gillis | |
| 6,966,520 | B2 | 11/2005 | Sherman | |
| 7,406,753 | B2 | 8/2008 | LaScala | |
| D587,989 | S | 3/2009 | Johansson | |
| 7,509,713 | B2 | 3/2009 | Lewis | |
| D604,589 | S | 11/2009 | Johansson | |
| 7,636,986 | B2 | 12/2009 | Sorenson | |
| 2008/0000056 | A1 | 1/2008 | Murray | |
| 2008/0313869 | A1 | 12/2008 | Combes | |
| 2009/0260195 | A1 | 10/2009 | Howard | |

OTHER PUBLICATIONS

All about Tarps and camping: http://www.angelfire.com/ia3/camping/tarps.htm as of Apr. 19, 2010.

* cited by examiner

*Primary Examiner* — Jack W. Lavinder
(74) *Attorney, Agent, or Firm* — Rosenberg, Klein & Lee

(57) ABSTRACT

A system and method are provided for constructing an intermediate securement point for a flexible panel. A stopper unit having at least one retention portion disposed over an engagement portion is provided with the retention portion extending radially beyond the engagement portion. A clip unit detachably coupled to the stopper unit to capture the flexible panel therebetween includes a collar portion defining an engagement channel configured to receive the engagement portion of the stopper unit. The collar portion terminates at first and second opposed ends spaced across a mouth of the engagement channel. An intermediate portion of the flexible panel may then be wrapped over the retention portion of the stopper unit to be gathered and releasably captured about the engagement portion by the clip unit coupled thereto. A flexible tie member may be coupled to the clip unit for releasably anchoring the clip unit to a support fixture.

20 Claims, 10 Drawing Sheets

SYSTEM AND METHOD FOR SECURING A FLEXIBLE PANEL

RELATED APPLICATION DATA

This Application is based on Provisional Patent Application Nos. 61/307,877, filed 25 Feb. 2010; 61/379,470, filed 2 Sep. 2010; and, 61/419,239, filed 2 Dec. 2010.

BACKGROUND OF THE INVENTION

Field of the Invention

The subject system and method for securing a flexible panel is generally directed to the securement of a sheet-like flexible panel member to an anchoring point. More specifically, the system and method provides for simply and conveniently constructing a securement point at any intermediate part of the flexible panel which may be without any preconfigured securement feature.

The system and method employ an assembly of units for the ready attachment of a tie member to a tarpaulin, canopy, a fabric sheet, or other flexible panel material, such that it may be securely tied down or otherwise supported for use. The system obviates the need for any grommets, piercing, or other special provision in the sheet-like material itself to accommodate the securement.

In camping, gardening, storage, and various other applications both outdoors and indoors, there often arises a need for securing parts of the flexible panel so that it may be adequately supported to serve a certain function. The flexible panel may already be equipped with attachment measures for this purpose. In the case of a tent canopy, for example, the canopy may be formed with grommet-encircled eyelets, attachment loops, or other pre-configured fastening measures along certain edge or corner portions. The canopy may be propped up by tent poles and/or support lines engaging its fastening measures.

Where such pre-configured attachment measures are provided with a flexible panel, and use is made under ordinary expected conditions, securement of the flexible panel becomes rather straight forward. Where use is to be made under out of the ordinary, unexpected conditions, however, the pre-configured attachment measures may not provide adequate points for securement. For instance, if the shape and size of the area to be covered by the panel deviates from a requisite shape and size, or if the relative locations and orientations of the available supports and/or anchoring points are inconsistent with that of the pre-configured attachment measures, it may be difficult to safely secure the flexible panel for use.

Limiting the points of securement for a flexible panel to such pre-configured attachment measures severely restricts versatility of use. Conversely, adding extraneous attachment measures to regain some of this versatility not only promotes waste, it may also introduce functional deficiencies. If too many eyelets are provided in a flexible panel, for example, each unused eyelet may pose a potential threat of leakage.

Where no such attachment measures are provided at all on a flexible panel, the panel's effective securement, at least without piercing or other destructive modification of the panel, remains a challenge. The challenge is particularly pronounced at intermediate regions of the panel. Although edge portions of the panel may be subject to jaw-grip type clipping/clamping type mechanisms, the more interior regions of the panel are not quite so accessible to such mechanisms. Thus, there remains a need for a system and method by which a reliable securement point may be quickly and conveniently established at portions of a flexible panel not otherwise equipped with adequate attachment measures. There remains a need for such system and method which establishes a securement point at those portions of the flexible panel without damage or modification of the flexible panel.

PRIOR ART

The published art known to Applicant as of the subject Patent Application's filing include U.S. Patent and Patent Application Publication Nos.: U.S. Pat. Nos. 5,168,605; 2,939,195; 3,936,912; 5,074,014; 5,033,170; 4,688,304; #D604,589; #2009/0260195; U.S. Pat. Nos. 7,509,713; #D587,989; #2008/0313869; U.S. Pat. No. 7,406,751; #2008/0000056; U.S. Pat. Nos. 6,473,944; 6,148,488; 5,752,297; 5,692,272; 4,939,820; 3,780,400; and, 1,383,665. There is no system or method heretofore known which realizes the combination of simplicity and structural integrity provided herein to establish a securement point for a flexible panel member.

SUMMARY OF THE INVENTION

It is an object of the present invention to provide a system and method for establishing a stable securement point for a flexible panel.

It is another object of the present invention to provide a system and method for establishing such securement point at portions of the flexible panel not otherwise equipped with adequate attachment/fastening measures.

It is yet another object of the present invention to provide a system and method for establishing a securement point for a flexible panel conveniently and simply, and without damaging the flexible panel.

These and other objects are attained in accordance with certain aspects of the present invention in a system for constructing an intermediate securement point for a flexible panel. The system includes a stopper unit having at least one retention portion disposed over an engagement portion, with the retention portion extending radially beyond the engagement portion. The system also includes a clip unit detachably coupled to the stopper unit to capture the flexible panel therebetween. The clip unit is provided with a collar portion defining an engagement channel configured to receive the engagement portion of the stopper unit. The collar portion terminates first and second opposed ends spaced across a mouth of the engagement channel. An intermediate portion of the flexible panel may then be wrapped over the retention portion of the stopper unit to be gathered and releasably captured about the engagement portion by the clip unit coupled thereto.

In certain embodiments of the system, a flexible tie member is coupled to the clip unit. The tie member may be coupled in such manner that it releasably anchors the clip unit to a support fixture.

In accordance with certain other aspects of the present invention, a method for intermediately securing a flexible panel comprises establishing a stopper unit having at least one retention portion disposed over an engagement portion, so that the retention portion defines a bulbous upper surface extending radially beyond the engagement portion. The method further includes establishing a clip unit configured for detachable coupling to the stopper unit to capture the flexible panel therebetween, with the clip unit including a body portion and a collar portion defining an engagement channel configured to receive the engagement portion of said stopper unit. The collar portion is formed to terminate at first and second opposed ends spaced across a mouth of the engagement channel. Each of the collar and body portions are formed with at least one fastening point. An intermediate portion of the flexible panel is wrapped over the retention portion of the stopper unit and gathered about the engagement portion, whereafter the clip unit is coupled to the engagement portion of the stopper unit to capture the gathered portion of the flexible panel thereagainst.

In certain embodiments of the method, a flexible tie member is also established for adjustably engaging the fastening points of the clip unit. The tie member is so coupled that it releasably anchors the clip unit to a given support fixture.

DETAILED DESCRIPTION OF THE PREFERRED EMBODIMENTS

Figure 1A:
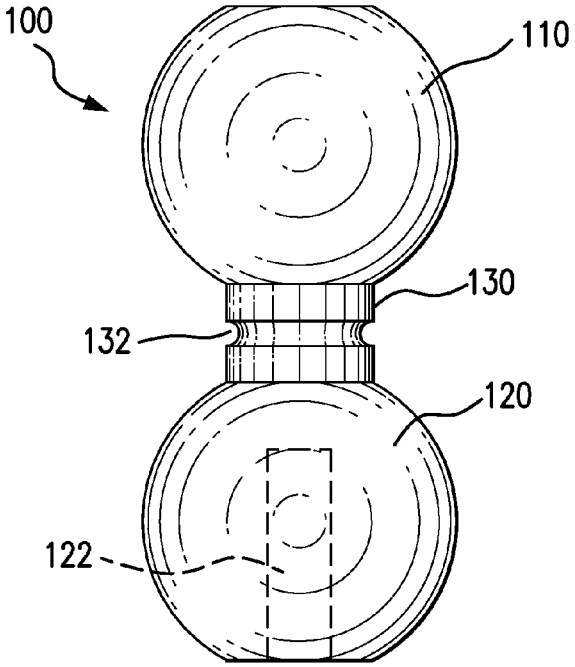
FIG. 1A is an elevational view of a stopper unit for a system formed in accordance with one exemplary embodiment of the present invention.
Figure 1B:
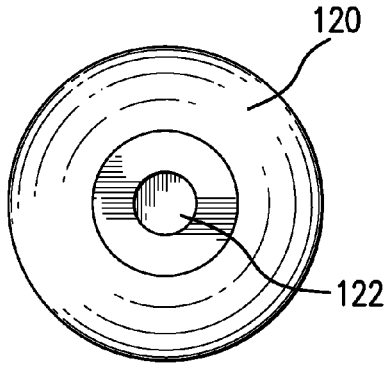
FIG. 1B is a bottom plan view of the stopper unit embodiment illustrated in FIG. 1A.
Figure 1C:
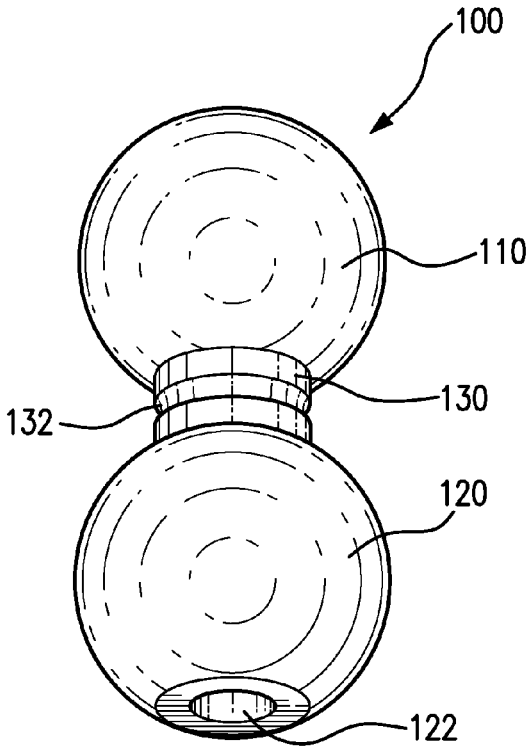
FIG. 1C is a perspective view of the stopper unit embodiment illustrated in FIGS. 1A-1B.

Referring now to FIGS. 1A-1C and FIGS. 2-3, stopper and clip units 100, 200 are used in combination to realize a system and method in accordance with illustrative embodiments of the present invention. In the illustrative embodiments shown, the system and method employ a stopper unit 100 having upper and lower retention portions 110, 120 joined by an engagement portion 130 extending therebetween. At least one, preferably both, of the retentions portions, 120 is configured to extend radially beyond the engagement portion 130, so that when an intermediate portion of a flexible panel material is wrapped thereover, it may be bunched together and retentively captured against the engagement portion 130. Toward that end, at least the upper retention portion 110 is formed with a bulbous or other generally arcuate contour free of sharp corners or edges so that various types of flexible panel materials, such as woven fabric, nylon, other textiles, elastomers, and the like may be stretched over and safely pulled against/along the surface of that retention portion 110, without the undue risk of tearing or snagging.

The upper and lower retention portions 110, 120 may be, but need not be, substantially identical in overall contour and configuration. In certain applications, they may be differently configured depending on the particular requirements of the intended application. Preferably, the stopper unit 100 is formed in this embodiment with a mounting bore for receiving a tent pole or some other panel support member. In this exemplary embodiment, a mounting bore 122 is formed into at least the lower retention portion 120. In alternate embodiments, a similar mounting bore may also be formed into the upper retention portion 110 such that the stopper unit 100 is provided with reversible symmetry. In other alternate embodiments, for example, where the lower retention portion 120 is either slight in structure or nonexistent, a similar internal bore may be formed to extend into or even through the engagement portion 130 itself. In still other embodiments, the stopper unit 100 may be formed without any mounting bore at all, with the stopper unit 100 being utilized in a suspended, line-tension state (as described in following paragraphs), or with other external means for affixing the stopper unit 100 onto a panel support member.

The mounting bore 12 may be surrounded by a smooth cylindrical inner surface for receiving a pole-tipped support member. In alternate embodiments, the surrounding inner surface may be suitably formed with other features to enable firm yet detachable mounting. For example, the inner surface may be ribbed for slip fitting the pole, or threaded for accepting a pole with a threaded end or adapter.

The engagement portion 130 defines a dimensionally narrowed neck area beneath the upper retention portion 110 about which the given panel material draping over the upper retention portion 110 may be gathered and drawn to be there collared by a clip unit 200. To facilitate the clip unit's engagement, engagement portion 130 is preferably formed in the illustrated embodiment with an intermediate groove 132 that provides sufficient clearance for passage through the narrowest parts of the clip unit's engagement channel.

The stopper unit 100 and its constituent portions may be formed of any suitable material known in the art. Depending on the requirements of the intended application, for instance, the various portions of the stopper unit 100 may be formed of wood, metal, dense plastic/rubber, composite, stone, or a combination of these and other such suitable materials. As it serves as the core of a securement point constructed for an intermediate part of a flexible panel by the disclosed system, it is important that the material(s) making up the stopper unit 100 be of sufficient strength and rigidity to maintain a structurally sound base for the resulting securement point.

In certain embodiments, it may be preferable to enhance the frictional grip of the given panel material by forming at least a part of the upper retention portion 110 of a high friction material such as a dense rubber composition. Alternatively, the outer surface of the retention portion 110 may be at least partially coated with such a high friction composition or provided instead with nodules, protuberances, or other such grip-enhancing measures, taking care to avoid features prone to snagging or tearing the panel material.

Like the stopper unit, clip unit 200 may be formed of any suitable material known in the art, so long as it is of sufficient strength and rigidity to preserve the structural integrity of the securement point it forms with the stopper unit. Preferably, the clip unit 200 in the illustrated embodiment is formed integrally of a metal or dense plastic material having substantial strength and rigidity to withstand the tie-down tension applied by a tie member thereto without excessive deflection or buckling. The clip unit's structure would preferably afford some degree of deflection (at the extremities of its collar portion, for instance), where necessary, to permit snap-fit engagement of the stopper unit 100 with the flexible panel material bunched around it.

Figure 2:
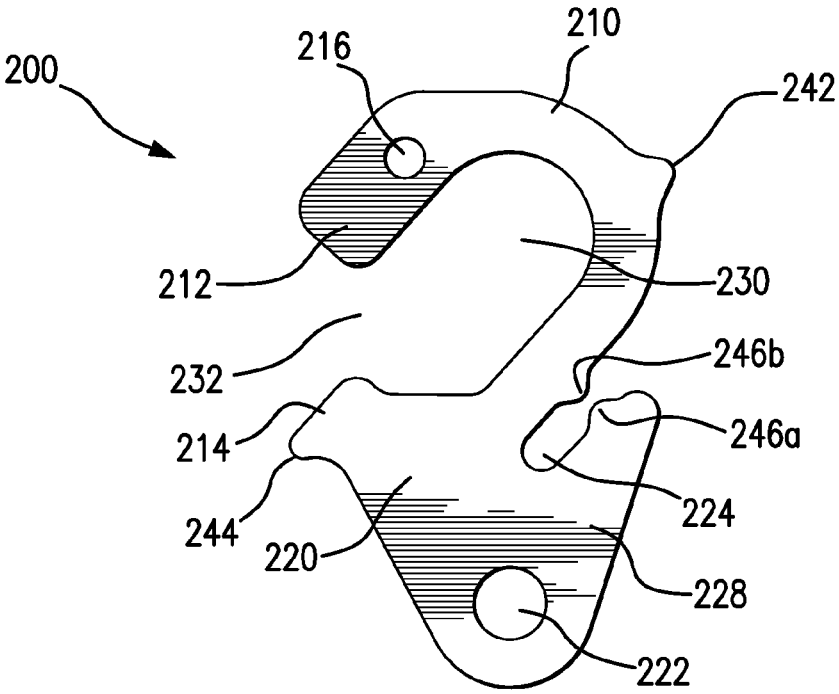
FIG. 2 is an elevational view of a clip unit for a system formed in accordance with an exemplary embodiment of the present invention.
Figure 3:
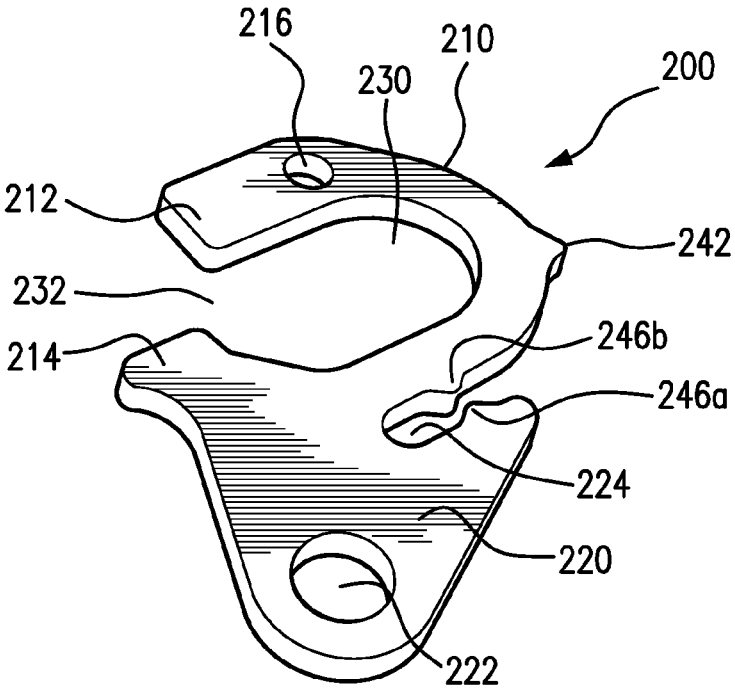
FIG. 3 is a perspective view of the clip unit embodiment illustrated in FIG. 2.

As shown in FIGS. 2-3, clip unit 200 includes a collar portion 210 which extends from a body portion 220 to define an engagement channel 230. The collar portion 210 is preferably formed with a generally C-shaped contour terminating at a free end 212 whose tip opposes that of an end 214. The tips formed on these opposed ends 212, 214 are spaced across a reduced-width opening, or mouth 232, into the engagement channel 230 which ends at a concave inner periphery of the collar portion 210. This concavity enables the collar portion 210 to receive the stopper unit's engagement portion 130, together with the panel member portion gathered thereabout, in cradled manner. Preferably, the ends 212, 214 are formed with an angled/sloped contour to help guide the panel-wrapped engagement portion 130 into the mouth 232 of the clip unit 200.

The clip unit 200 is formed in this embodiment with a generally planar, plate-like structure. The engagement channel 230 at its widest portion is preferably wide enough to receive the neck of the stopper unit and surrounding material of the flexible panel, but narrower than the diametric extent of the stopper unit's spherical retention portions. In this regard, the mouth 232 is preferably narrower than the neck of the stopper unit so that once the clip unit is forced onto the neck of the stopper unit (by snap-fitting or by passage about the intermediate groove 132 of the neck), the clip unit resists detachment.

The engagement channel 230 is dimensioned in width and length to receive and provide ample clearance about the engagement portion 130 of the stopper unit to also receive the flexible panel member gathered around the engagement portion 130. The length of this channel 230 is preferably extended far enough in on the clip unit 200 that the stopper unit's panel-wrapped engagement portion 130 is received deeply enough away from the mouth 232 (recessed into the cradling end of the channel 230) to guard against unwanted escape through the open mouth 232. Preferably, the mouth 232 is dimensioned with a sufficiently reduced width (relative to that of the engagement channel 230) to further guard against such unwanted release of the stopper unit's engagement portion 130.

In the illustrated embodiment, the width of the mouth 232 is preferably set so that the tips of the opposed ends 212, 214 will readily clear and pass the intermediate groove 132 (with the panel material gathered around it), yet block the other parts of the engagement portion 130 (with the panel material gathered around it) against passage. During typical use, therefore, a user would either snap fit the clip unit 200 onto the stopper unit's neck beneath the upper retention portion, or guide the clip unit into engagement by aligning its mouth 232 substantially with the stopper unit's intermediate groove 132, advancing the clip unit 200 until the stopper unit's neck (engagement portion 130) is fully received in the channel 230, then sliding the clip unit 200 either axially upward along the neck to abut the upper retention portion 110. This axial displacement removes the mouth 232 from alignment with the engagement groove 132, effectively locking the engagement thereby.

The body portion 220 provides an area of somewhat more concentrated mass to support one or more intermediate pivoting/fastening points for a tie member. The body portion 220 is formed in the illustrated embodiment with a through hole 222 which defines a second fastening point. It is also formed in the illustrated embodiment with an open slot 224 defining a third fastening point. As described in following paragraphs, the formation of this third fastening point as an open slot affords a cleat-like structure for quick release of a tie member that may have been secured thereto. One need only slide off that portion of a tension line held within the slot to release tension and permit untying and release of such tie member.

The clip unit 200 in this embodiment is formed with a plurality of peripheral protrusions to facilitate usage. Protrusion 242 is formed midway along the outer arcuate periphery of the collar portion 210. This provides a pressing point against which a user may apply leverage when slipping or rotating the collar portion 210 laterally into/out of engagement with the stopper unit's engagement portion 130. Similarly, protrusion 244 is disposed at a lateral extremity of the collar portion's end 214 to provide a pressing point against which a user may apply leverage to laterally rotate the clip unit 200 when disengaging from the stopper unit's engagement portion 130. The opposed protrusions 246*a*, 246*b* formed to protrude into the fastening slot 224 serve to guard against the unwanted release of a tie member back out through the slot. Depending on the particular requirements of the intended application, some or all of these protrusions may be repositioned or even omitted. Conversely, depending on the needs of the intended application, additional protrusions of like or other configuration may be applied elsewhere on the clip unit 200.

By cooperative use of the clip and stopper units 200, 100 in the manner described herein, a securement point may be effectively constructed virtually anywhere on the intermediate expanse of flexible panel material. There is no need to pre-configure grommets, eyelets, or other fixed points of attachment on the flexible panel. Each securement point constructed in accordance with the present invention provides sufficient structural integrity at any intermediate part of the flexible panel to serve in supporting, tying down, or suspending the panel as necessary according to the intended use.

Figure 4A:
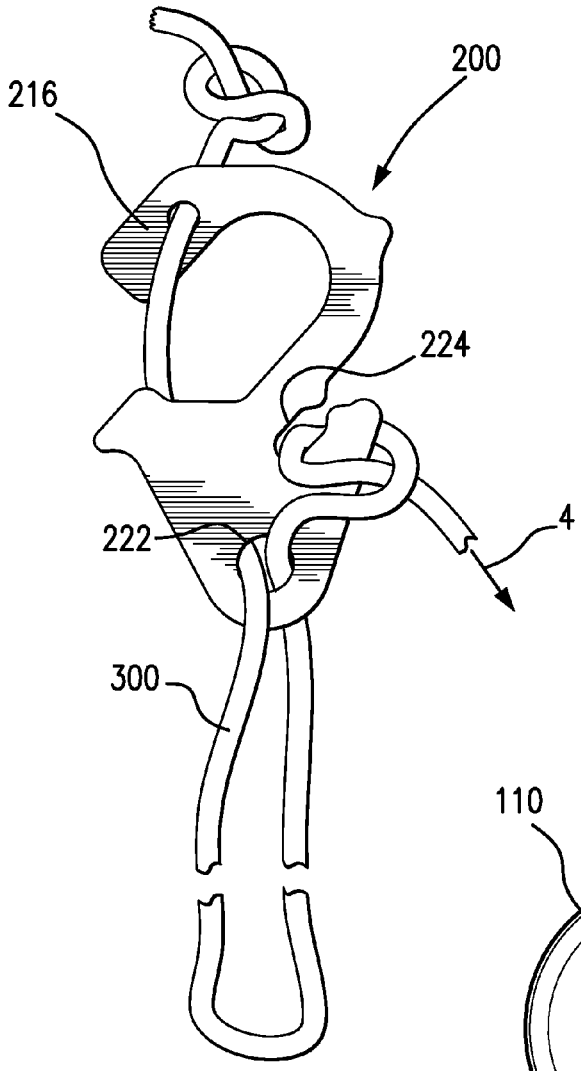
FIG. 4A is a plan view, partially cut away, of the clip unit embodiment of FIGS. 2-3, illustrated with an exemplary tie member coupled thereto.
Figure 4B:
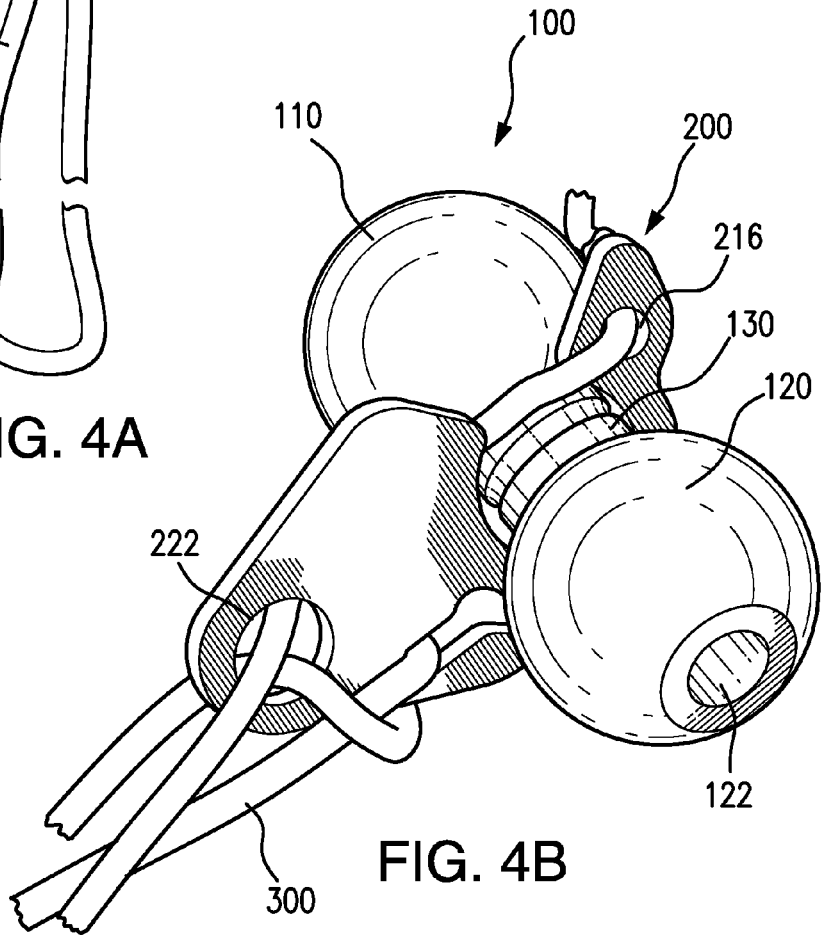
FIG. 4B is a perspective view, partially cut away, of a system including the stopper and clip units and tie member of FIGS. 1A-4A, illustratively shown functionally assembled to establish a securement point on a flexible panel member (with the flexible panel member not shown, for clarity)

Preferably, a tie member 300 is employed with clip unit 200 toward those ends. As illustrated in FIGS. 4A, 4B, the tie member 300 may be coupled to the clip unit 200 via its various fastening points 216, 222, 224 for tightly tying the clip unit 200 to a nearby anchoring/support fixture.

The tie member 300 may be extended directly between one clip unit 200 and an anchoring point (provided by a ground stake, tree, building structure, or the like). Alternatively, the tie member 300 may in certain applications pass between two clip units 200 of mutually displaced securement points respectively established on the flexible panel. A mounting bore 122 may be formed in each of the stopper units 100 (of the respective securement points) to be transversely directed, so as to cooperatively receive a horizontal pole or other frame member extending therebetween.

In the embodiment illustrated, the tie member 300 is coupled so that it links a part of the clip unit's collar portion 210 near the free end 212 (via the fastening point 216) to the body portion 200 (via the fastening point 222), before it is routed on to an anchoring point. Drawing the tie member 300 tight has the bracing effect of drawing the terminal region of the collar portion 210 (near the free end 212) towards the body portion 220, and tighter about the stopper unit's engagement portion 130 and gathered panel material cradled by the collar portion. Extending the tie member 300 to an anchoring point directly from just the second fastening point 222 of the body portion 220 (or directly from just the first fastening point 216 of the collar portion 210) could have the undesirable effect of generating opposed pulling forces on the collar and body portions 210, 220. That is, tugging on one portion causes the other to push against the stopper unit from the other side. Such unbraced application of force against the stopper unit 100 could unduly stress an intermediate point along the collar portion 210.

Referring to FIGS. 4A-5B, system 10 is typically used as follows. The stopper unit 100 is placed under an intermediate portion of the given tarp, canopy, or other sheet-like flexible panel 20. From the other side, the panel 20 is wrapped over a bulbous retention portion 110 then gathered around the engagement portion 130 of the stopper unit 100, which in the exemplary embodiment shown is configured as a neck formed with an intermediate annular groove 132. A clip unit 200 is then fitted about the gathered panel material to capture the same about the stopper unit's engagement portion 130.

A rope, cord, or other tie member 300 is coupled to a fastening point, such as a through opening 216, formed on the clip unit's collar portion 210. Preferably, one end of the tie member 300 is knotted or otherwise configured (with a cord stop attachment, for example) to anchor that end to the collar portion 210. The tie member 300 is initially loosened sufficiently to permit the clip unit 200 to be snapped or slipped on to engage the neck of the stopper unit 100 with the gathered panel member material captured between the two devices. The tie member 300 is then tightened by pulling its free end away from the clip unit 200 and across the mouth 232 of the clip unit collar portion 210, thereby removing slack and trapping the gathered panel fabric and the stopper unit to remain engaged within the collar portion. The free end of the tie member 300 is preferably routed under the clip unit's body portion 220 and passed up and out via a through hole 222 formed therein to serve as another fastening point. The tie member 300 is then extended and looped around some anchor point, such as a ground stake, tree, or some other available support fixture, then returned back to the clip unit. The tie member 300 may then be passed through the engagement slot 224, looped under itself and pulled as indicated by arrow 4 to tighten the tie member 300 without the use of knots.

The through opening 222 of the clip unit's body portion 220 is configured such that the tie member 300 remains fairly free-running through it. This allows the smooth transfer of forces from the clip unit's collar portion 210, where the tie member 300 is knotted to opening 216. The tie member 300 may be taken from the opening 222 to an attachment point (not pictured), and preferably brought back to the clip unit 200, fed in the opposite direction through opening 222, around a side of the device and through the slot 224, and then secured by looping under itself over a surrounding area 228 of the body portion 220. The through opening 222 may be sized and shaped so that it remains available for use as an attachment point for various accessory devices.

Routing the tie member 300 through holes 222 and 224 and looping under area 228 in this manner leaves the tie member 300 to be conveniently tightened by pulling the free end away from the clip unit 200. Once tightened, the tie member 300 is pinched between the clip unit's body portion 220 (around the area 228) and itself, thereby forming a "pinch loop" which resists release/movement in the opposite direction. Optionally, the surface of the clip unit 200 at the area 228 where the rope is pinched may be roughened or knurled for increased holding power.

As mentioned, the clip unit 200 may be used on a stopper unit 100 without attaching a tie member 300 to an anchoring point. All slack would then be removed from the tie member 300 (or the tie member altogether removed and set aside) and the resulting assembly used solely as a securement point for a tent pole or other accessory.

When the system is tensioned, that is when the given canopy, tarp, or other flexible panel and tie member 300 are subjected to forces in opposite directions, the panel-wrapped spherical end of the stopper unit is pulled tightly against the clip unit, pinching the flexible panel between the clip and stopper units. The mounting bore of the stopper unit enables the resulting securement point to be mounted on a standard tent pole and used as described in preceding paragraphs. Alternatively, the securement point may remain be tensioned as such, but not mounted over any support member, to realize a 'flying canopy' type structure using the flexible panel member.

Figure 5A:
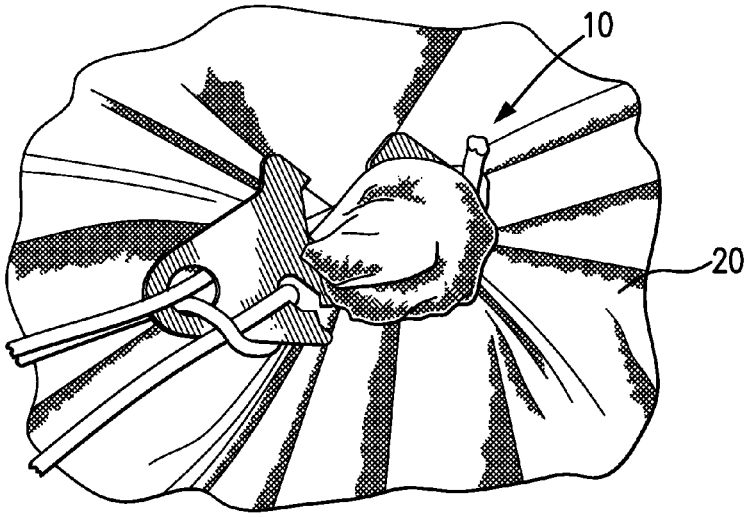
FIG. 5A is a perspective view, partially cut away, of the system illustrated in FIG. 4B, installed to construct a securement point on a flexible panel member.
Figure 5B:
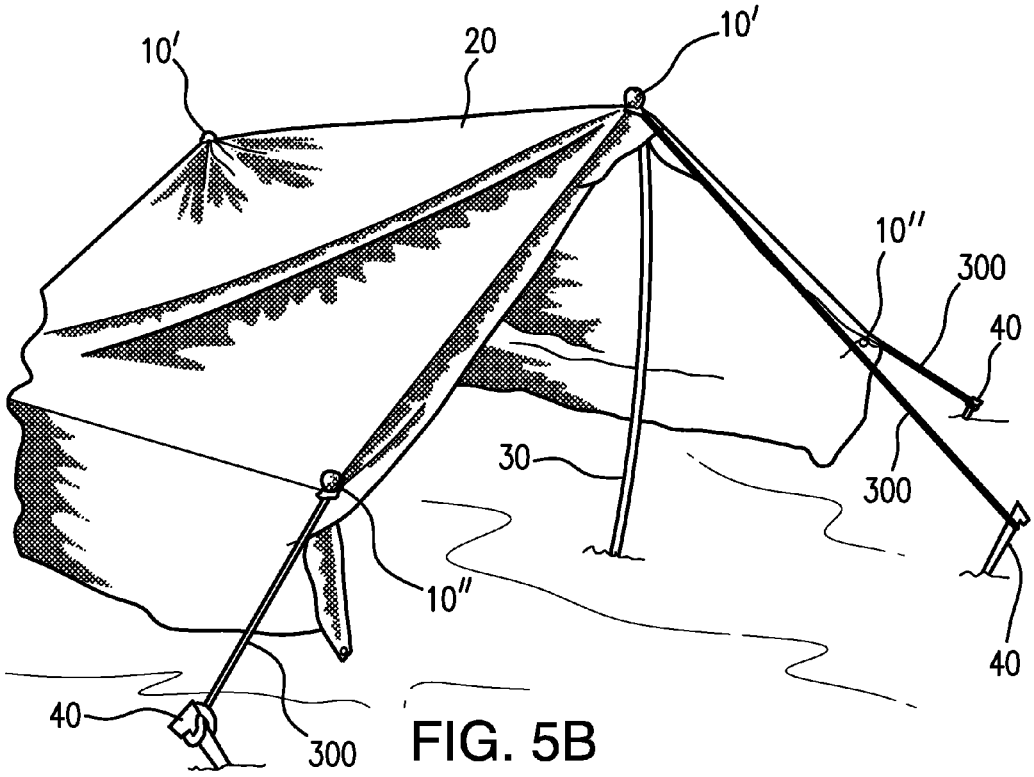
FIG. 5B is a perspective view, partially cut away, of an exemplary application of the system shown in FIG. 5A, installed at numerous points of a tent canopy to construct securement points for securely supporting the tent canopy.

FIGS. 5A-5B illustrate system 10 as installed to establish various securement points on a flexible panel—in this case a canvas tent canopy 20. As shown in this example, a pair of securement points 10' are established to define peak points of support for the desired tent shelter. Each of the stopper units 100 of the systems at these securement points 10' is mounted upon a tent pole 30 (which inserts into the stopper unit's mounting bore 122). A flexible cord 300 serves as a tie member for each of the securement points 10', each being knotted and passed through a corresponding clip unit 200, looped about a ground stake 40, then returned, tensioned, and tied to such clip unit 200.

A plurality of auxiliary securement points 10" are established at laterally displaced wing portions of the tent canopy 20 using respective systems 10. Unlike securement points 10', the stopper unit 100 at these auxiliary securement points 10" are not mounted to any tent pole. Rather, each of these securement points 10" is suspended and tension-tied to a corresponding ground stake 40. Alternatively, this or any other securement point 10', 10" could be similarly tied to a tree, vehicle, building, or other suitable structure/fixture that may be available.

Figure 6A:
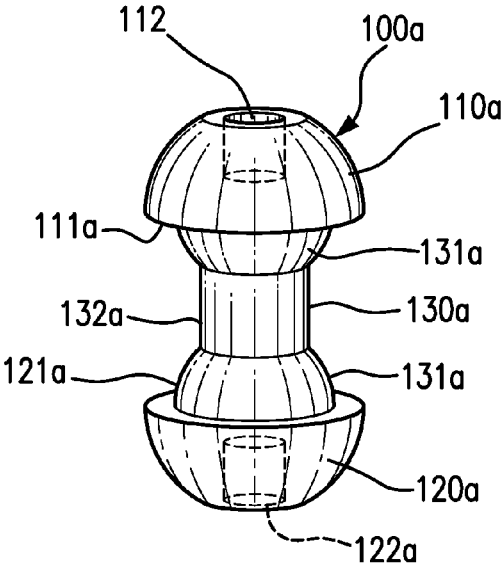
FIG. 6A is a perspective view illustrating an example of a stopper unit formed in accordance with an alternate embodiment of the present invention.
Figure 6B:
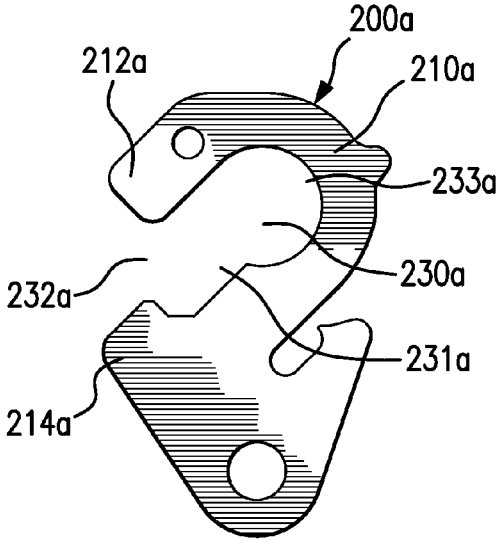
FIG. 6B is a plan view illustrating an example of a clip unit formed in accordance with an alternate embodiment of the present invention corresponding the stopper unit embodiment of FIG. 6A.
Figure 7A:
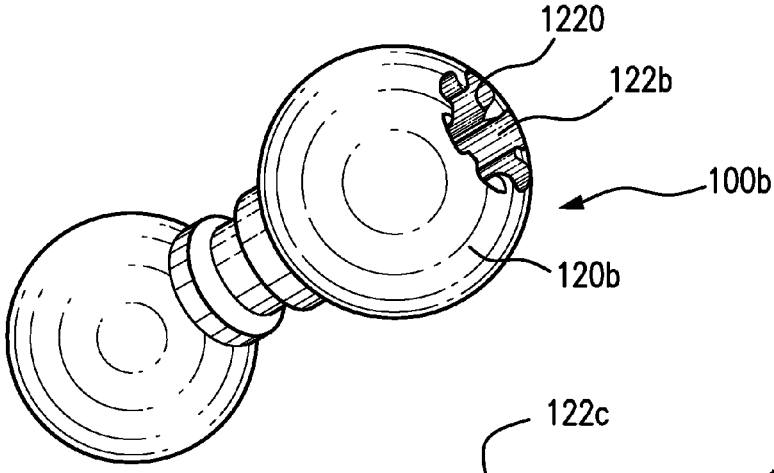
FIGS. 7A-7D are perspective views illustrating additional examples of a stopper unit formed in accordance with various alternate embodiments of the present invention.
Figure 7B:
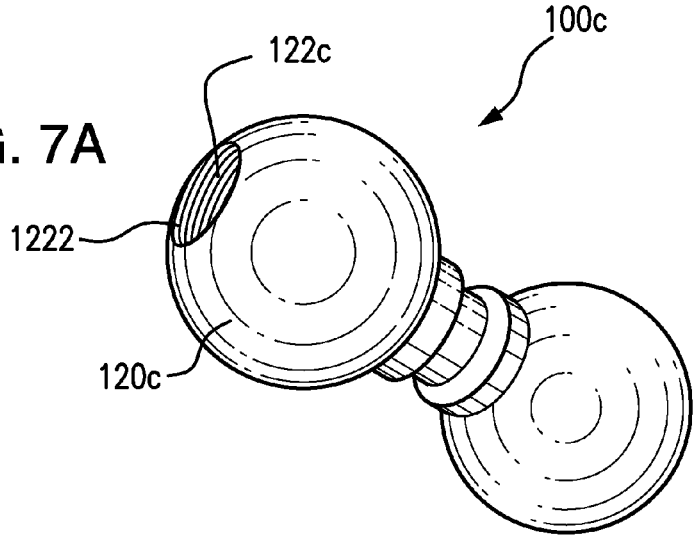
Figure 7C:
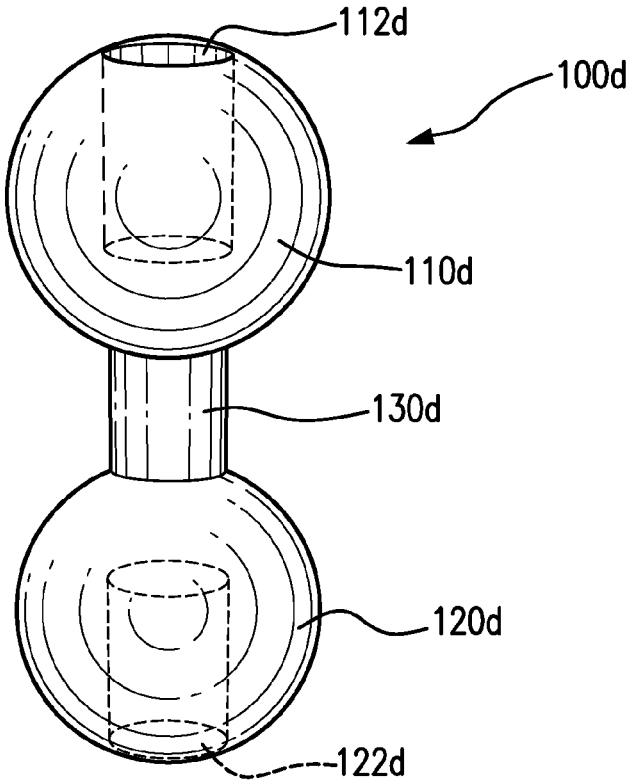
Figure 7D:
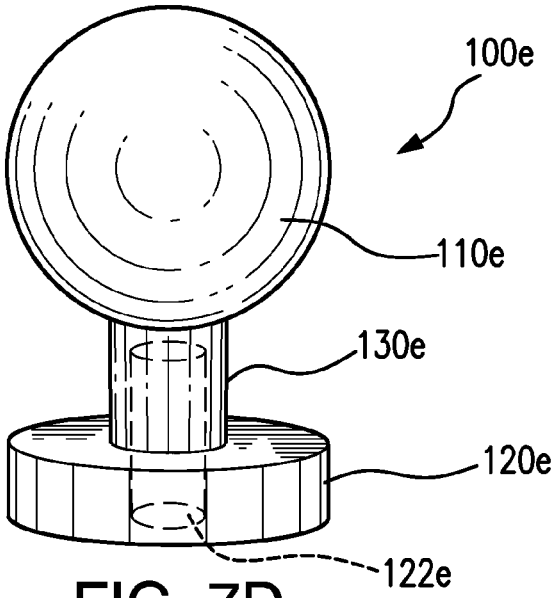

Turning to FIGS. 6A-6B, there are shown alternate embodiments of the stopper unit 100*a* and clip unit 200*a* which may be employed in cooperation with one another. The stopper 100*a* in this embodiment is formed with a pair of retention portions 110*a*, 120*a* at axially opposed ends of an engagement portion 130*a*. The stopper unit 100*a* is generally formed with a symmetric configuration, such that either of the retention portions 110*a*, 120*a* may be used as the upper portion about which the flexible panel may be wrapped. Accordingly, each of the retention portions 110*a*, 120*a*, defines a bulbous surface; and, each is formed with a mounting bore 112*a*, 122*a* extending axially therein, such that it may serve as the bottom portion capable of receiving the upper tip of a support member.

Each retention portion 110*a*, 120*a* is also formed with an abrupt circumferential interruption, as it radially overhangs the engagement portion 130*a*. This defines between each retention portion 110*a*, 120*a* and the engagement portion 130*a* an annular lip 111*a*, 121*a*. The stopper unit's profile abruptly reduces in diameter at each lip 111*a*, 121*a*, after which the engagement portion 130*a* is tapered (via a spherical surface 131*a*) to the cylindrical stem 132*a* of the resulting neck structure. The circumferential ledge defined by each lip 111*a*, 121*a* enhances stability of a resulting securement point, as the flexible panel material is gathered at the reduced-diameter engagement portion 130*a* over such circumferential ledge. The pinching effect at the ledge as the clip 200*a* captures the panel material gathered about the stem 132*a* enhances the grip and hold of the panel material.

The clip unit 200*a* in this embodiment is formed with an engagement channel 230*a* shaped to complement the engagement portion profile of stopper 100*a*. The engagement channel 230*a* is entered through a reduced width mouth 232*a* which opens into an extended narrow section 231*a* before opening further into a rounded wide section 233*a*. As in the preceding embodiment, the innermost wide section 233*a* of the channel 230*a* serves to receive and cradle the stopper unit's engagement portion 130*a* and panel material gathered thereabout. In this embodiment, though, the reduced width of the narrow section serves as a constriction that helps to retain and thereby stabilize the cradled engagement. The engagement is further stabilized, and the hold of the panel material further strengthened, by the cupped mating of this wide channel section 233*a* with the spherically tapered surfaces 131*a* of the stopper unit 130*a*.

FIGS. 7A-7D illustrate additional examples of stopper units 100*b*-100*e* which may be employed in accordance with various other alternate embodiments of the present invention. Stopper unit 100*b* is similar in structure to stopper unit 100 illustrated in FIGS. 1A-1C, except that the mounting bore 122*b* in its retention portion 120*b* is provided with a plurality of longitudinally extended ribs 1220 formed along the surrounding inner wall to enhance grip on an inserted support member. Stopper unit 100*c* is also similar to stopper unit 100, except that the mounting bore 122*c* in its retention portion 120*c* is provided with a plurality of threads 1222 formed along the surrounding inner wall for receiving a correspondingly threaded support member.

Stopper unit 100*d* is formed with a symmetric configuration, such that either of its retention portions 110*d*, 120*d* may be used as the upper portion about which the flexible panel may be wrapped. Accordingly, the retention portions 110*d*, 120*d* each define a bulbous surface extending radially beyond a substantially cylindrical engagement portion 130*d* disposed axially therebetween. Each retention portion 110*d*, 120*d* is also formed with a mounting bore 112*d*, 122*d* extending axially therein, such that it may serve as the bottom portion having the capability to receive the upper tip of a support member. Unlike the embodiments of FIGS. 1A-1C and 6A-6B, the axial ends of the retention portions 110*d*, 120*d* are not flattened (such as about the entries of the mounting bores 122, 122*a*, 112). Instead, the spherical contour is substantially maintained, except as interrupted by a mounting bore 112*d*, 122*d*.

Stopper unit 100*e* is similar in part to that of the preceding embodiment. In this embodiment, the lower retention portion 120*e* is formed as a stop member forming a shoulder radially about the neck, or engagement, portion 130*e*. A mounting bore 122*e* formed in the retention portion 120*e* then extends axially into the engagement portion 130*e* as shown to provide sufficient depth for stable mounting upon a support member.

Figure 8A:
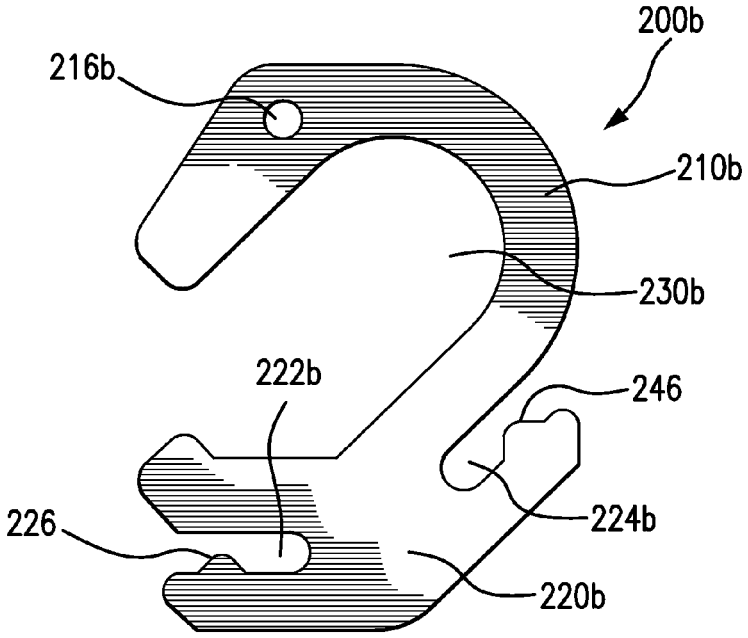
FIG. 8A is a plan view illustrating another example of a clip unit formed in accordance with an alternate embodiment of the present invention.

Referring to FIG. 8A, there is shown a clip unit 200*b* formed in accordance with another embodiment of the present invention. Clip unit 200*b* is configured with a first fastening point formed as a through opening 216*b* in its collar portion 210*b*, much as in preceding embodiments. For heightened versatility, however, second and third fastening points are provided on the clip unit's body portion 220*b* in the form of fastening slots 222*b*, 224*b*, each guarded by a protrusion 226, 246. These slots 222*b*, 224*b* provide a cleat structure about which a tie member 300 may be pivoted or tied in slidably releasable manner.

Figure 8B:
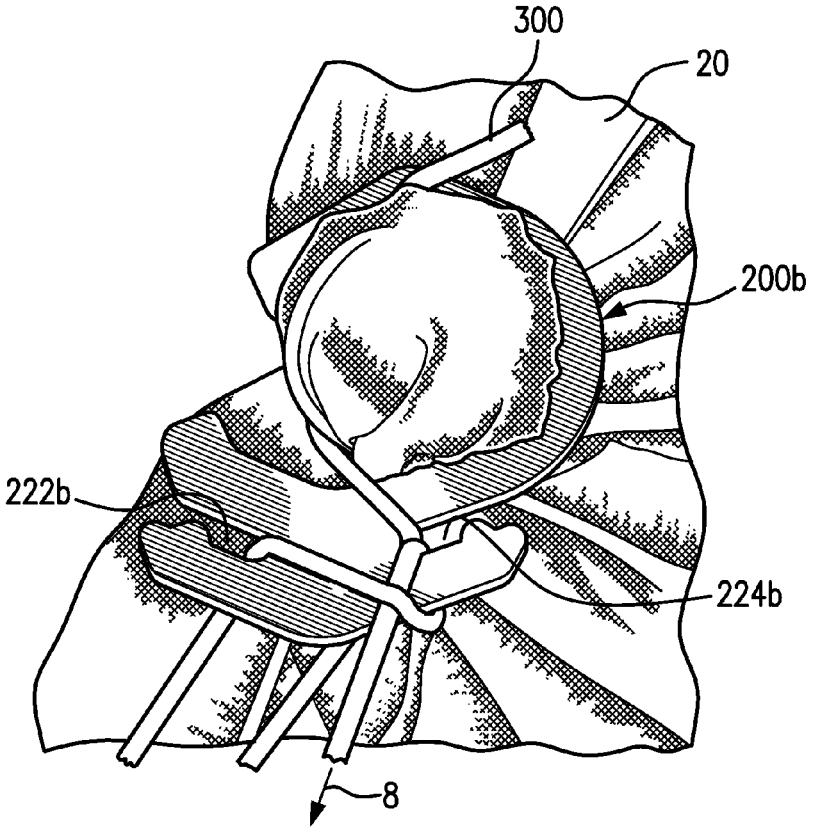
FIG. 8B is a perspective view, partially cut away, of the system employing the clip unit embodiment of FIG. 8A with a stopper unit embodied such as shown of FIGS. 1A-C, installed to construct a securement point on a flexible panel member.

FIG. 8B illustrates this clip unit 200*b* in use, installed over a sheet 20 of panel material engaging a stopper unit disposed underneath. A tie member 300 may be variously routed through the clip unit's fastening points to secure the sheet 20 as desired. The routing of tie member 300 is slightly different in this illustrated example from that shown in FIG. 4A. The tie member is passed through the opening 216*b*, with a knotted part serving as a stop. As before, the tie member 300 is initially loosened sufficiently to permit the clip unit 200*b* to be slipped about the sheet 20 gathered over the neck of the given stopper unit underneath, and to cradle the same in its engagement channel 230*b*. The tie member 300 is then passed around the exposed side of the sheet-covered stopper unit, down through the engagement slot 224*b* of the clip unit 200*b*, and tightened by pulling its free end away from the clip unit 200*b*. This removes slack and traps the gathered sheet material and the stopper unit within the collar portion 210*b*. The free end of the tie member 300 is then extended and looped around a nearby ground stake, tree, or some other available support fixture, and thereafter returned back to the clip unit 200*b*, where it is pivoted through the engagement slot 222*b*, then pulled and tied to engagement slot 224*b* using a pinch loop.

FIGS. 9A-F illustrate additional examples of clip units 200*c*-200*h* which may be employed in accordance with various other alternate embodiments of the present invention. The various features discussed in connection with preceding embodiments of the clip unit may be configured as necessary to suit the particular requirements of the intended application. Preferably, the clip unit is configured for use with more than one stopper unit configuration.

Figure 9A:
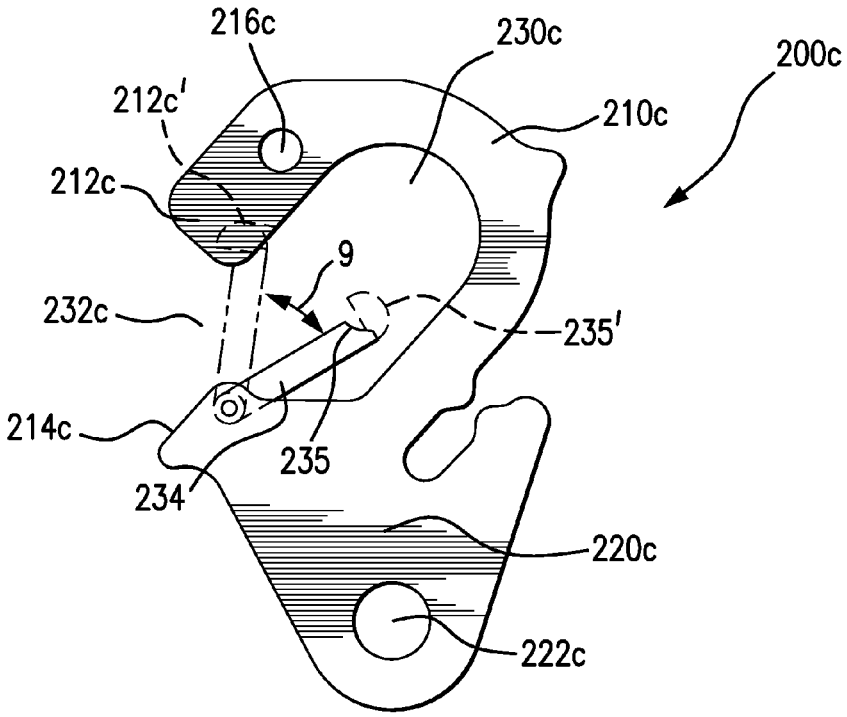
FIG. 9A is a plan view illustrating another example of a clip unit formed in accordance with an alternate embodiment of the present invention.
Figure 9B:
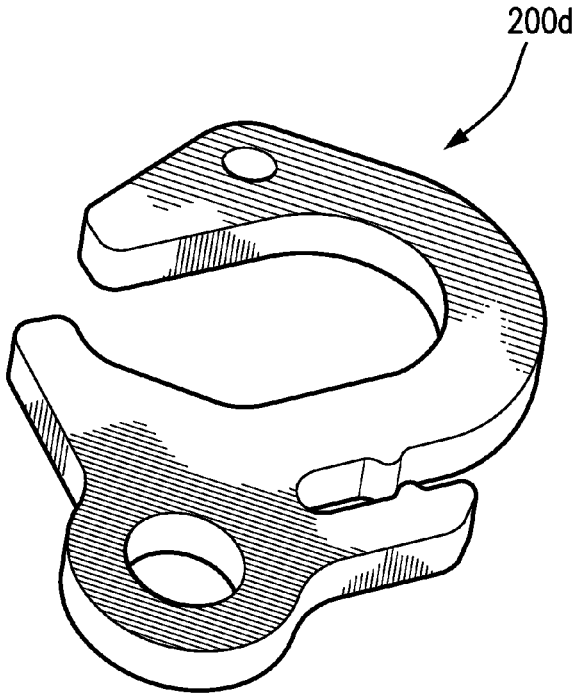
FIG. 9B is a perspective view illustrating a further example of a clip unit formed in accordance with an alternate embodiment of the present invention; and, FIGS. 9C-9F are plan views illustrating additional examples of a clip unit formed in accordance with various alternate embodiments of the present invention.
Figure 9C:
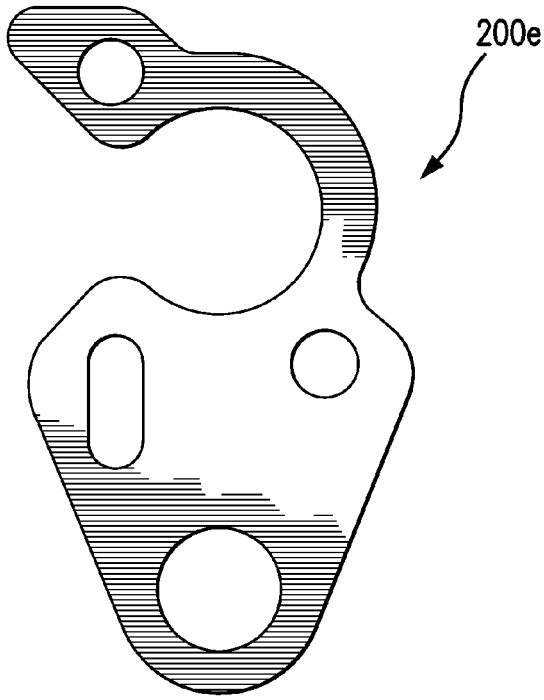
Figure 9D:
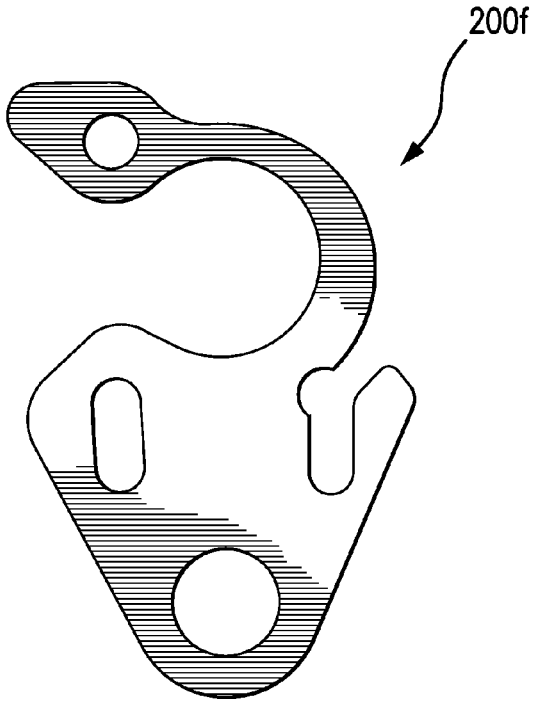
Figure 9E:
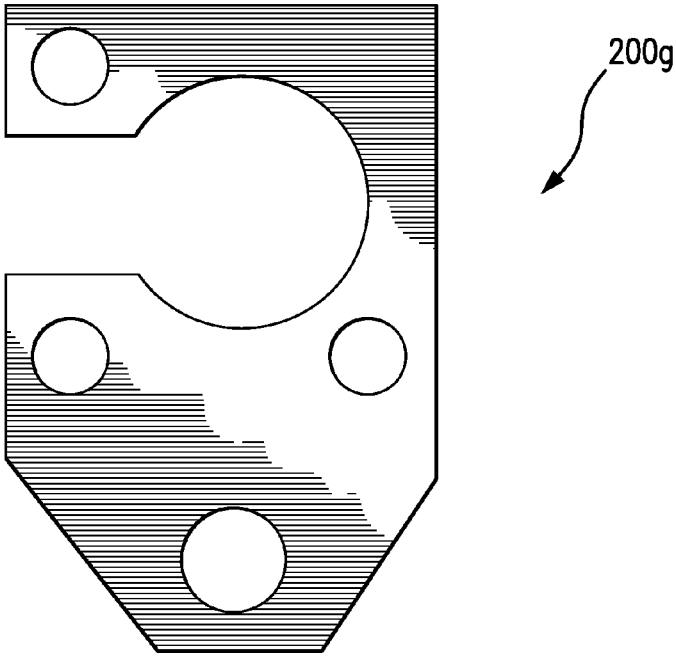
Figure 9F:
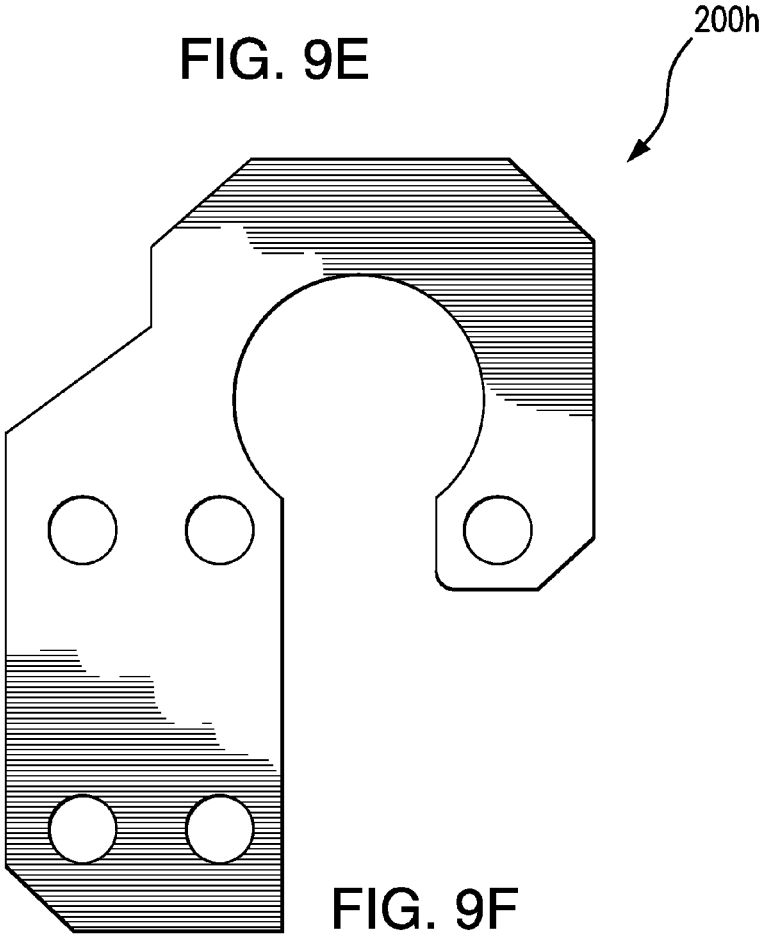

Among the examples of clip unit configurations shown in FIGS. 9A-F, the clip 200*c* of FIG. 9A is similar to clip unit 200 of FIGS. 2-5B, except that the mouth 232*c* of its engagement channel 230*c* is mechanically gated. A locking member 234 is coupled to the clip unit 200*c* for displacement between open and closed positions. The locking member 234 is disposed in the open position to open access (of the given stopper unit) through the mouth 232, and in the closed position to close access by sufficiently obstructing the mouth 232. In the illustrated embodiment, for example, the locking member 234 is formed as a sprung gate mechanism, being pivotally coupled to one of the opposed ends 212*c*, 214*c* to bear against the other of the ends 212*c*, 214*c* in the closed position, and swinging reversibly out of the way to an open position (as indicated by the bidirectional arrow 9). Preferably, the locking member 234 is spring biased to its closed position, and configured much in the manner of a snap link found in a carabiner mechanism or the like.

Structural simplicity may be preserved by configuring the locking member 234 and clip unit 200*c* as illustrated, such that when the locking member 234 is in its closed position, its free end 235 would simply abut an edge surface of the end 212*c* (preferably in conformed manner). This would be without any latching, hooking, or other suitable measures for retaining this engagement between the locking member 234 and the clip unit end 212*c*. As described in preceding paragraphs, it is preferable in many applications to brace the clip unit's free-ended collar portion 210*c* to its body portion 220*c* to retain structural integrity when the clip unit is placed under tension during use. One approach is to link the portions together as before, by coupling a tie member 300 between respective fastening points like the through opening 216*c* near the free end of the collar portion 210*c* and the through opening 222*c* in the body portion 220*c*.

An alternate approach is to brace the collar and body portions together via the locking member 234 itself. For example, the collar portion's end 212*c* may be formed with a suitable structure, such as a latching notch 212*c*', and the locking member 234 suitably formed with a latch end 235' corresponding thereto. To the extent permitted by the given application, these features may be transposed so that a notch-type structure is conversely provided on the locking member 234 while a corresponding latch structure is provided on the end 212*c*. The latch feature 235', in any event, would be matedly engage the latching notch 212*c*' when the locking member 234 is in its closed position. The mated engagement would effectively latch the collar and body portions 210*c*, 220*c* together so that one is braced against the other when the collar unit 200*c* is tensioned by opposing forces during use.

As a point of note, this latching structure would obviate the need for tie member coupling between the collar and body portions, at least for bracing purposes. That would in turn obviate the need for a through opening 216*c* in the collar portion 210*c*, yielding a stronger, more solid collar portion 210*c*.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular steps or processes may be reversed or interposed, all without departing from the spirit or scope of the invention as defined in the appended claims.

What is claimed is:

1. A system for constructing an intermediate securement point for a flexible panel comprising:

a stopper unit, the stopper unit having at least one retention portion disposed over an engagement portion, said retention portion extending radially beyond said engagement portion; and, a clip unit detachably coupled to said stopper unit to capture the flexible panel therebetween, said clip unit including a collar portion defining an engagement channel configured to receive said engagement portion of said stopper unit, said collar portion terminating at first and second opposed ends spaced across a mouth of said engagement channel;

whereby an intermediate portion of the flexible panel wrapped over said retention portion of said stopper unit is gathered and releasably captured about said engagement portion by said clip unit coupled thereto;

wherein said retention portion of said stopper unit defines a bulbous upper surface, said engagement portion defining an annular neck projecting from a lower surface of said retention portion; and, said stopper unit includes a pair of opposed retention portions joined by said annular neck extending axially therebetween, each of said retention portions forming a substantially spherical body.

2. The system as recited in claim 1, further comprising a flexible tie member coupled to said clip unit for releasably anchoring said clip unit to a support fixture.

3. The system as recited in claim 2, wherein said clip unit includes a body portion extending from said collar portion, each of said collar and body portions being formed with at least one fastening point configured for engagement by said tie member.

4. The system as recited in claim 3, wherein at least one said fastening point in each of said collar and body portions is defined by a through opening formed therein.

5. The system as recited in claim 4, wherein said body portion includes a plurality of fastening points formed thereon, at least one of said fastening points of said body portion being defined by a slotted through opening.

6. The system as recited in claim 5, wherein said body portion is formed with a protrusion extending into said slotted through opening for guarding against slip release of said tie member from said slotted through opening.

7. The system as recited in claim 5, wherein said body portion is formed with a pair of said slotted through openings defining respective fastening points, and a protrusion extending into at least one of said slotted through openings for guarding against slip release of said tie member therefrom.

8. The system as recited in claim 1, wherein at least one said retention portion of said stopper unit defines a bulbous upper surface, said engagement portion defining an annular neck projecting from a lower surface of said retention portion.

9. The system as recited in claim 1, wherein said stopper unit is formed with a mounting bore extending therein for receiving a panel support member.

10. The system as recited in claim 9, wherein at least a portion of said mounting bore is defined by an inner surface having a plurality protuberances formed thereon.

11. The system as recited in claim 9, wherein said mounting bore extends into at least one said retention portion.

12. The system as recited in claim 1, wherein said clip unit includes a locking member displaceably coupled to said clip unit for selectively obstructing at least a portion of said engagement channel mouth.

13. A system for constructing an intermediate securement point for a flexible panel comprising:

a stopper unit, the stopper unit having opposed retention portions joined by an engagement portion extending therebetween, said retention portions each extending radially beyond said engagement portion;

a clip unit detachably coupled to said stopper unit to capture the flexible panel therebetween, said clip unit including a collar portion defining an engagement channel configured to receive said engagement portion of said stopper unit, said collar portion terminating at first and second opposed ends spaced across a mouth of said engagement channel;

a flexible tie member coupled to said clip unit for releasably anchoring said clip unit to a support fixture;

whereby an intermediate portion of the flexible panel wrapped over at least one said retention portion of said stopper unit is gathered and releasably captured about said engagement portion by said clip unit coupled thereto, said retention portions emerging from opposing sides of said clip unit to displaceably retain said engagement portion within said engagement channel thereof;

wherein said clip unit includes a body portion extending from said collar portion, each of said collar and body portions being formed with at least one fastening point configured for engagement by said tie member; at least one said fastening point in each of said collar and body portions is defined by a through opening formed therein; and, said body portion includes a plurality of fastening points formed thereon, at least one of said fastening points of said body portion being defined by a slotted through opening;

wherein:

a portion of said tie member is knotted to retentively engage said through opening of said collar portion, said tie member extending therefrom to slidably engage a first of said body portion fastening points, loop around the stationary fixture, then return to pivot about said first body portion fastening point and slidably engage a second of said body portion fastening points;

an intermediate portion of said tie member traverses said engagement channel of said collar portion to constrictively trap said engagement portion of said stop unit therein; and, said tie member is thereby disposed for adjustable tightening against said clip unit.

14. A system for intermediately securing a flexible panel comprising:

a stopper unit, the stopper unit having at least one retention portion disposed over an engagement portion, said retention portion defining a bulbous upper surface extending radially beyond said engagement portion, said stopper unit having a mounting bore formed therein for receiving a panel support member;

a clip unit detachably coupled to said stopper unit to capture the flexible panel therebetween, said clip unit including a body portion and a collar portion defining an engagement channel configured to receive said engagement portion of said stopper unit, said collar portion terminating at first and second opposed ends spaced across a mouth of said engagement channel, each of said collar and body portions being formed with at least one fastening point; and, a flexible tie member adjustably engaging said fastening points of said clip unit for releasably anchoring said clip unit to a support fixture, said flexible tie member extending across said engagement channel to trap said stopper unit engagement portion therein;

whereby an intermediate portion of the flexible panel wrapped over said retention portion of said stopper unit is gathered and releasably captured against said engagement portion by said clip unit for supported suspension of the flexible panel.

15. The system as recited in claim 14, wherein at least one said fastening point in each of said collar and body portions is defined by a through opening formed therein.

16. The system as recited in claim 15, wherein said body portion includes a plurality of fastening points formed thereon, at least one of said fastening points of said body portion being defined by a slotted through opening.

17. The system as recited in claim 14, wherein said stopper unit includes a pair of opposed retention portions joined by an annular neck extending axially therebetween, each of said retention portions forming a substantially spherical body, said mounting bore being formed to extend into said spherical body of at least one said retention portion.

18. A method for intermediately securing a flexible panel comprising the steps of:

establishing a stopper unit having opposed retention portions joined by an engagement portion extending therebetween, at least one said retention portion defining a bulbous upper surface extending radially beyond said engagement portion;

establishing a clip unit configured for detachable coupling to said stopper unit to capture the flexible panel therebetween, said clip unit including a body portion and a collar portion defining an engagement channel configured to receive said engagement portion of said stopper unit, said collar portion terminating at first and second opposed ends spaced across a mouth of said engagement channel, each of said collar and body portions being formed with at least one fastening point;

wrapping an intermediate portion of the flexible panel over at least one said retention portion of said stopper unit and gathering about said engagement portion;

coupling said clip unit to said engagement portion of said stopper unit to capture the gathered portion of said flexible panel thereagainst, said retention portions emerging from opposing sides of said clip unit to displaceably retain said engagement portion within said engagement channel thereof;

establishing a flexible tie member for adjustably engaging said fastening points of said clip unit to releasably anchor said clip unit to a support fixture;

wherein:

a portion of said tie member is knotted to retentively engage said through opening of said collar portion, said tie member is extended therefrom to slidably engage a first of said body portion fastening points, loop around the stationary fixture, then return to pivot about said first body portion fastening point and slidably engage a second of said body portion fastening points;

an intermediate portion of said tie member is tensioned to traverse said engagement channel of said collar portion for constrictively trapping said engagement portion of said stop unit therein; and, said tie member is adjustably tightened against said clip unit.

19. A method for intermediately securing a flexible panel comprising the steps of:

establishing a stopper unit having at least one retention portion disposed over an engagement portion, said retention portion defining a bulbous upper surface extending radially beyond said engagement portion;

establishing a clip unit configured for detachable coupling to said stopper unit to capture the flexible panel therebetween, said clip unit including a body portion and a collar portion defining an engagement channel configured to receive said engagement portion of said stopper unit, said collar portion terminating at first and second opposed ends spaced across a mouth of said engagement channel, each of said collar and body portions being formed with at least one fastening point;

wrapping an intermediate portion of the flexible panel over said retention portion of said stopper unit and gathering about said engagement portion; and, coupling said clip unit to said engagement portion of said stopper unit to capture the gathered portion of said flexible panel thereagainst;

wherein a mounting bore is established in said stopper unit for receiving a panel support member, said stopper unit being mounted on a terminal end of a frame member with said mounting bore of said stopper unit coaxially receiving the terminal end.

20. The method as recited in claim 19, further comprising the step of establishing a flexible tie member for adjustably engaging said fastening points of said clip unit to releasably anchor said clip unit to a support fixture.

* * * * *